United States Patent [19]

Fiala et al.

[11] Patent Number: 5,074,215

[45] Date of Patent: Dec. 24, 1991

[54] ANTI-FOULING CONNECTOR FOR ELECTRONICALLY DETONATED MUNITIONS

[75] Inventors: John P. Fiala, Forest Hill; Irving F. Barditch, Baltimore, both of Md.

[73] Assignee: The United States of America as represented by the Secretary of the Army, Washington, D.C.

[21] Appl. No.: 551,108

[22] Filed: Jul. 9, 1990

[51] Int. Cl.[5] ..... F41A 19/69

[52] U.S. Cl. ..... 102/293; 89/28.05

[58] Field of Search ..... 102/293, 282, 202.9; 89/28.05

[56] References Cited

U.S. PATENT DOCUMENTS 2,789,467 4/1957 Rosenthal ..... 89/28.05

*Primary Examiner*—Charles T. Jordan

*Attorney, Agent, or Firm*—Anthony T. Lane; Edawrd Goldberg; Michael C. Sachs

[57] ABSTRACT

The present invention relates to an apparatus and method for clearing the fouling black powder residues deposited on the electrical connectors of electrically detonated munitions. A female connector is provided with a recurved lanced outer spring clip which automatically scrapes off the residue on an insulator and contact surfaces of a male bipolar connector plug when the two connectors are rotated with respect to each other.

4 Claims, 2 Drawing Sheets

3
10
12
14
2
2
18
16
3

18
20
14
26
16
10
22
24
30

28
32'
34'
32
34
42
42'
43'
43

FIG. 4
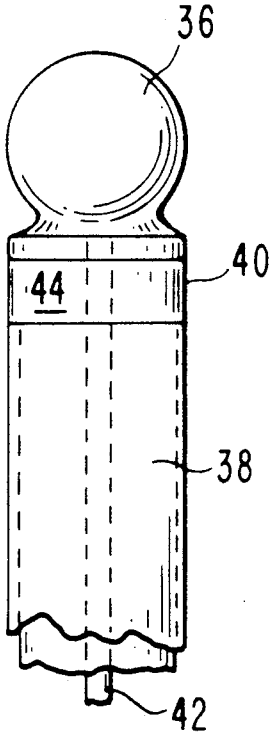
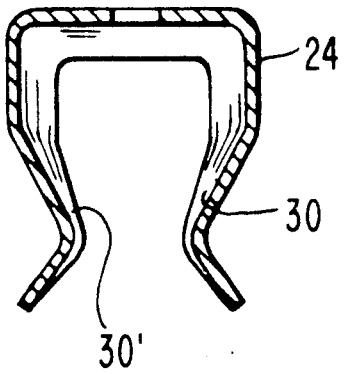
FIG. 3

ANTI-FOULING CONNECTOR FOR ELECTRONICALLY DETONATED MUNITIONS

GOVERNMENTAL INTEREST

The invention described herein may be manufactured, used and licensed by or for the Governmental purposes without the payment to us of any royalty thereon.

BACKGROUND OF THE INVENTION

The present invention relates to connectors used with black powder munitions which are electrically detonated.

The problem with the present state of the art electrical connectors used for detonating munitions containing black powder as an explosive has been the fouling of the connector by a residue from the black powder which leaves a hard electrically conductive deposit on an insulator section of the male plug portion of the connector. Previous means for dealing with this problem consisted of using a bristle type wire brush with or without cleaning fluids to clean the contaminated insulator. The effectiveness of this cleaning technique has been controversial, because of the number of misfires that still persisted after the connectors had bene so called cleaned.

The present invention is superior to prior art devices because the female portion of the connector has been constructed with lance-like protruding sharp scrapers thereon which automatically clear away the shorting residue from the male connector when the male portion of the connector is rotated within the female portion of the connector.

It has been noticed that automatic cleaning by rotation of the male and female parts of the connector prevents fouling build-up, thus drastically reducing the number of misfires, improving the safety of the ordnance handling crew, and increasing the efficiency of the munition testing operation.

SUMMARY OF THE DISCLOSURE

The present invention relates to an anti-fouling female connector which has operatively disposed thereon lance-like projections positioned on the inner surfaces of a portion of an outer female connector. The female connector is comprised of two nested spring clip monostructures of unequal length which are mounted at right angles to each other and electrically insulated from one another. The outer spring clip female connector member tips have been recurved to facilitate insertion of the munition on the male connector.

An object of the present invention is to provide an anti-fouling connector for electrically detonated munitions which use black powder as an explosive.

Another object of the present invention is to provide an anti-fouling connector which automatically removes an electrically conductive residue from the insulator section of a male connector member.

Another object of the present invention is to provide an anti-fouling connector for use on electrically detonated black powder explosives wherein the female outer spring clip connector tips have been recurved and provided with lance elements to facilitate insertion of the male connector and to simultaneously scrape electrically conductive residue from the insulator of the male connector when the male and female sections are rotated with respect to each other.

A further object of the present invention is to provide an electrical connector for use in detonating black powder munitions which automatically cleans itself at each use and thereby prevents fouling residue build-ups.

For a better understanding of the present invention, together with other and further objects thereof, reference is made to the following descriptions taken in connection with the accompanying drawings.

BRIEF DESCRIPTION OF THE DRAWINGS

FIG. 3 is a partial cross-sectional view of the inner female spring clip element taken along line 3—3 of FIG. 1.

FIG. 4 is a plan view of the male connector.

Throughout the following description, like reference numerals are used to denote like parts of the drawings.

DESCRIPTION OF THE PREFERRED EMBODIMENT

Figure 1:
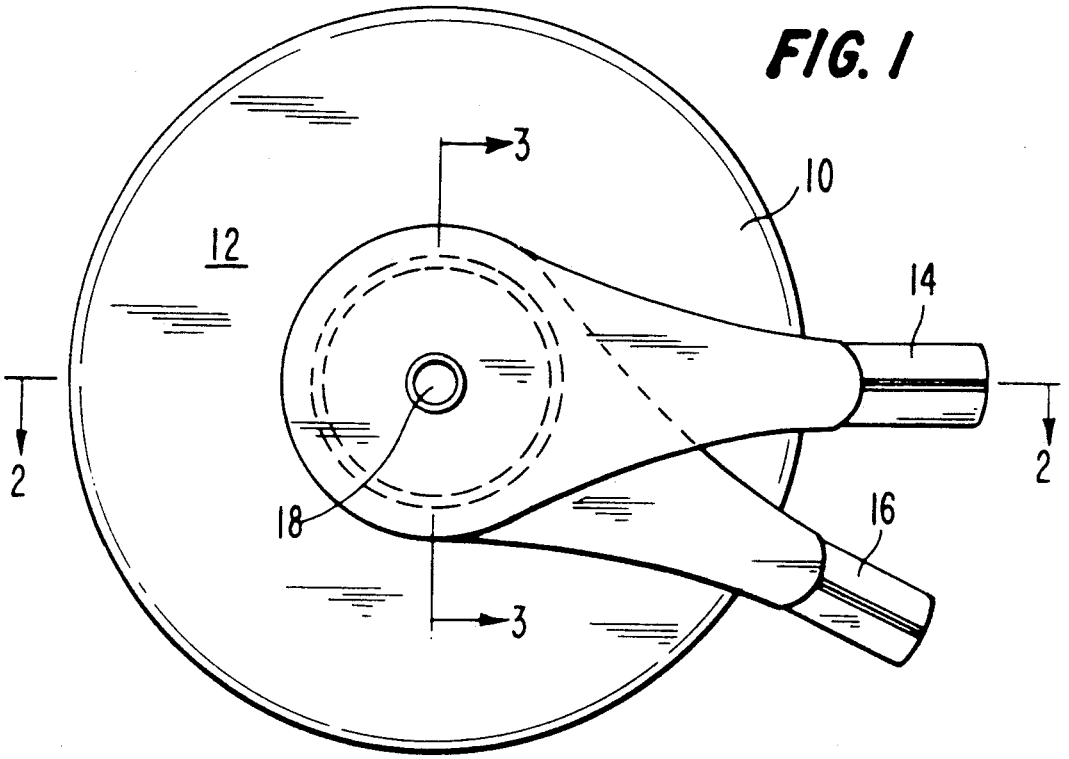
FIG. 1 is a plan view of the top of the female connector which is normally mounted on a munition showing the outer case and two electrical connecting lugs.

Referring now to FIG. 1, the present invention has a cup-shaped flanged housing 10 which supports on its outer top surface 12 a pair of electrical wire connecting lugs 14 and 16. The electrical wire connecting lugs 14 and 16 are centrally located and fixedly attached to the housing 10 by means of rivet 18.

Figure 2:
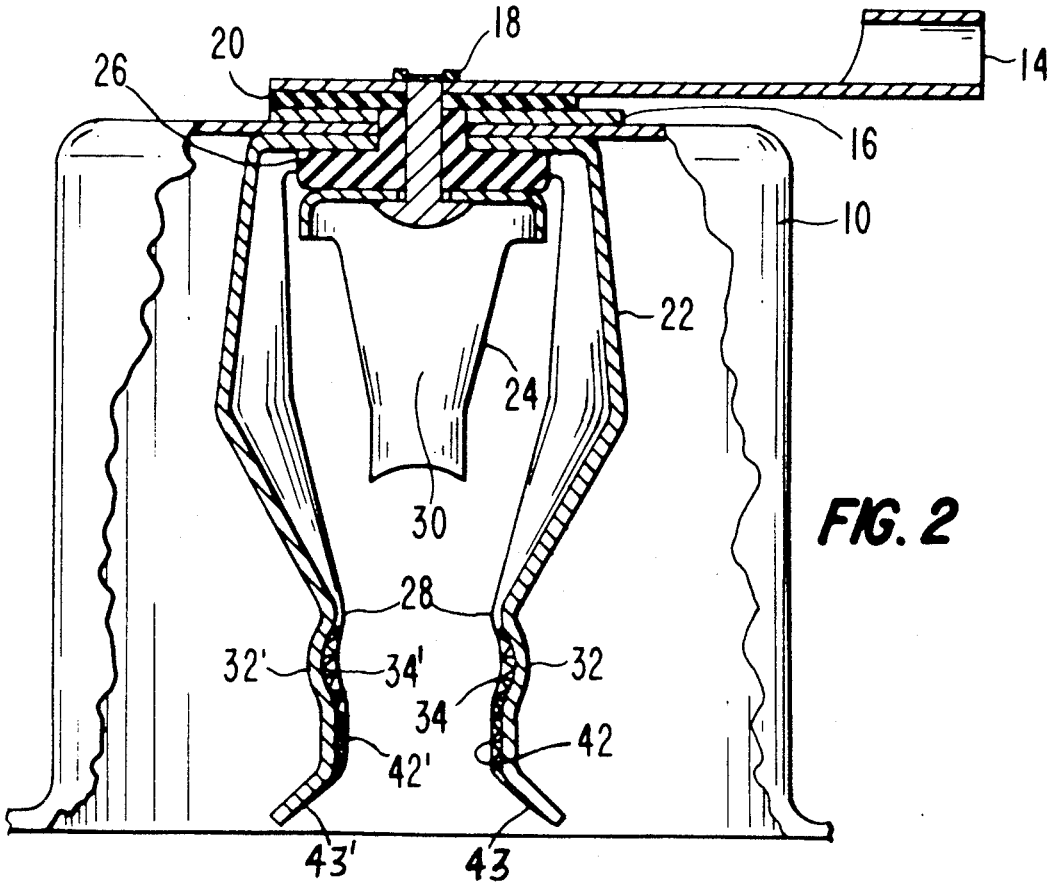
FIG. 2 is a cut-away partial cross-sectional view taken along line 2—2 of FIG. 1.

Referring now to FIGS. 2 and 3, disc-shaped external insulator spacer 20 electrically insulates electrical lugs 14 and 16 from each other. Electrical lug 16 is electrically connected to housing 10 and to the outer spring clip 22. Rivet 18 mechanically and electrically connects connecting lug 14 to an inner spring clip member 24. A second insulator member 26 is operatively disposed intermediate the cup-shaped inner surface of the outer spring clip 22 and the top of the cup-shaped surface of the inner spring clip. The outer and inner female spring clips 22 and 24 respectively are held in axial alignment with each other and in axial alignment with the housing 10. The monostructural inner spring clip 24 is operatively nested within the monostructural outer spring clip 22 and have their spring contact surfaces 30 and 28 respectively, disposed at right angles to one another. The cantilever tips 32 and 32' of spring clip 22 are spherically recurved to facilitate insertion of the munition held female spring clip housing assembly on to the male electrical connector shown in FIG. 4. The recurved tips 32 and 32' have been lanced to produce an inwardly protruding sharp scraper structure 34 and 34'.

Referring now to FIG. 4, the male bipolar electrical connector plug comprises a metal spherically-shaped contact 36 which is separated from a cylindrically-shaped contact sleeve 38 by a cylindrical insulator 40' which extends into the cylindrical contact sleeve 38 thereby insulating electrical surface 36 and its lead 42 from contact surface 38.

Referring now to both FIGS. 2 and 4, the recurved spherical tips 32 and 32' have been extended to form a lanced cylindrical-shaped sections 42 and 42' of a length to match the exposed insulator surface 44 between the male spherical contact 36 and the cylindrical contact 38.

In operation when the male connector plug shown in FIG. 4, has become fouled with a black powder residue it is inserted into the female outer spring clip through outwardly bent guide tips 43, 43' so that the ball-shaped contact 36 is temporarily positioned in the recurved lanced tips 32 and 32'. The female connector assembly of FIG. 2 is then rotated with respect to the male plug of FIG. 4 so that the fouling residue on the insulator of the male connecting plug and the other electrical contacting surfaces are scraped clean, thereby insuring successful firing. The clean male plug connector shown in FIG. 4 is then pushed further into the housing 10 so that good low resistance contact is made between contact 36 and the inner spring contact surfaces 30, and low resistance contact is additionally made between male contact surface 38 and female outer spring contact surfaces 28. The above procedure automatically clears the black powder residue after each firing thereby preventing residue fouling build-up.

While a specific embodiment of the invention has been shown and described in detail to illustrate the application of the principles of the invention, it will be understood that the invention may be embodied otherwise without departing from such principles.

What is claimed is:

1. An anti-fouling connector for electrically detonated munitions containing black powder as an explosive which comprises:

housing means for holding said anti-fouling connector on said munitions;

wire connecting lug means, operatively disposed externally on said housing means, for electrically igniting said black powder;

male bipolar connector plug means for supplying electrical current to said lug means; and female lanced spring clip means, operatively disposed in said housing means, for automatically cleaning residue from said male plug means when said plug means is inserted in said spring clip means and rotated therein, thereby preventing fouling residue build-up.

2. An anti-fouling connector as recited in claim 1 wherein said housing means includes:

an external disc-shaped insulator operatively disposed intermediate said wire connecting lug means;

a cup-shaped flanged housing member for externally supporting said wire lug mean and said disc-shaped insulator; and rivet means for electrically and mechanically connecting said wire connecting lug means to said housing means and to said spring clip means.

3. An anti-fouling connector as recited in claim 2 wherein said female lanced spring clip means includes:

an outer cup-shaped monostructural spring clip member axially operatively positioned in said flanged housing having cantilevered tips spherically recurved to facilitate insertion of said male plug means therein, and lanced to produce inwardly protruding scraper structure, said recurved tips having extended lanced cylindrical-shaped sections contiguous therewith, and of sufficient length to clean said bipolar plug means of residue;

an inner spring clip monostructure nested axially within said outer spring clip and mounted at right angles to said outer spring clip;

a second insulator member operatively disposed intermediate said inner and outer spring clips members for electrically insulating one from another.

4. An anti-fouling method for electrically detonated munitions comprising the steps of:

mounting a female spring clip connector on said munition;

providing two nested spring clip monostructures of unequal lengths mounted at right angles to one another and electrically insulated from each other;

recurving the tips of an outer spring clip to facilitate insertion of said munition on to a male bipolar connector;

lancing said recurved tips to produce sharp scraper structure on the inside; and rotating the male plug with respect to the female spring clips to scrape the fouling residue from an insulating spacer of said male plug and its electrical contact surfaces, thereby insuring successful functioning.

* * * * *